US005500277A

United States Patent [19]

Trakhan et al.

[11] Patent Number: 5,500,277

[45] **Date of Patent: * Mar. 19, 1996**

[54] MULTIPLE LAYER, MULTIPLE OPACITY BACKSIDE TEXTURED BELT

[75] Inventors: Paul D. Trokhan, Hamilton; Glenn D. Boutilier, Cincinnati, both of Ohio

[73] Assignee: The Procter & Gamble Company, Cincinnati, Ohio

[ * ] Notice: The portion of the term of this patent subsequent to Aug. 2, 2011, has been disclaimed.

[21] Appl. No.: 252,703

[22] Filed: Jun. 2, 1994

[51] Int. Cl.[6] ..... B32B 3/00

[52] U.S. Cl. ..... 428/196; 428/135; 162/900; 162/902; 162/903

[58] Field of Search ..... 428/135, 196; 162/900, 902, 903

[56] References Cited

U.S. PATENT DOCUMENTS

| | | | |
|---|---|---|---|
| 4,821,780 | 4/1989 | Tate | 139/383 A |
| 4,921,750 | 5/1990 | Todd | 428/225 |
| 4,941,514 | 7/1990 | Taipale | 139/383 A |
| 4,967,805 | 11/1990 | Chiu et al. | 139/383 A |
| 4,995,429 | 2/1991 | Kositzke | 139/383 R |
| 5,074,339 | 12/1991 | Vohringer | 139/383 A |
| 5,101,866 | 4/1992 | Quigley | 139/383 A |
| 5,114,777 | 5/1992 | Gaisser | 428/137 |
| 5,334,289 | 8/1994 | Trokhan et al. | 162/358.2 |

FOREIGN PATENT DOCUMENTS

| | | |
|---|---|---|
| 86110746 | 4/1986 | European Pat. Off. . |
| WO89/09848 | 10/1989 | WIPO . |
| WO91/14813 | 10/1991 | WIPO . |

OTHER PUBLICATIONS

Albany International advertisement: Forming Fabric Styles, 20M–3/90–R.

*Primary Examiner*—Christopher W. Raimund
*Attorney, Agent, or Firm*—Larry L. Huston; E. Kelly Linman; Jacobus C. Rasser

[57] ABSTRACT

A belt for through-air drying a cellulosic fibrous structure. The belt comprises two layers, a web contacting first layer and a machine facing second layer. The two layers are joined together by either adjunct tie yarns or integral tie yarns. The resulting belt has a backside texture caused by opaque yarns which shield actinic radiation. The opaque yarns are limited to the second layer, and do not tie the second layer to the first layer. The two layers may have vertically stacked machine direction yarns.

25 Claims, 3 Drawing Sheets

MULTIPLE LAYER, MULTIPLE OPACITY BACKSIDE TEXTURED BELT

FIELD OF THE INVENTION

The present invention relates to belts, and more particularly to belts comprising a resinous framework and a reinforcing structure, and yet more particularly to such a drying belt having a texture on the machine facing side, or backside, of the resinous framework.

BACKGROUND OF THE INVENTION

Cellulose fibrous structures, such as paper towels, facial tissues, and toilet tissues, are a staple of every day life. The large demand and constant usage for such consumer products has created a demand for improved versions of these products and, likewise, improvement in the methods of their manufacture. Such cellulosic fibrous structures are manufactured by depositing an aqueous slurry from a headbox onto a Fourdrinier wire or a twin wire paper machine. Either such forming wire is an endless belt through which initial deterring occurs and fiber rearrangement takes place.

After the initial formation of the web, which becomes the cellulosic fibrous structure, the papermaking machine transports the web to the dry end of the papermaking machine. In the dry end of a conventional papermaking machine, a press felt compacts the web into a single region cellulosic fibrous structure prior to final drying. The final drying is usually accomplished by a heated drum, such as a Yankee drying drum.

One of the significant aforementioned improvements to the manufacturing process, which yields a significant improvement in the resulting consumer products, is the use of through-air drying to replace conventional press felt dewatering. In through-air drying, like press felt drying, the web begins on a forming wire, which receives an aqueous slurry of less than one percent consistency from a headbox. Typically, initial dewatering takes place on the forming wire. The forming wire is not typically exposed to web consistencies of greater than 30 percent. From the forming wire, the web is transferred to an air pervious through-air-drying belt.

Air passes through the web and the through-air-drying belt to continue the dewatering process. The air passing the through-air-drying belt and the web is driven by vacuum transfer slots, other vacuum boxes or shoes, predryer rolls, etc., and molds the web to the topography of the through-air-drying belt, increasing the consistency of the web. Such molding creates a more three-dimensional web, but also causes pinholes, if the fibers are deflected so far in the third dimension that a breach in fiber continuity occurs.

The web is then transported to the final drying stage where the web is also imprinted. At the final drying stage, the through-air drying belt transfers the web to a heated drum, such as a Yankee drying drum for final drying. During this transfer, portions of the web are densifted during imprinting, to yield a multi-region structure. Many such multi-region structures have been widely accepted as preferred consumer products. An example of an early through-air-drying belt which achieved great commercial success is described in commonly assigned U.S. Pat. No. 3,301,746, issued Jan. 31, 1967 to Sanford et al.

Over time, further improvements became necessary. A significant improvement in through-air-drying belts is the use of a resinous framework on a reinforcing structure. This arrangement allows drying belts to impart continuous patterns, or, patterns in any desired form, rather than only the discrete patterns achievable by the woven belts of the prior art. Examples of such belts and the cellulosic fibrous structures made thereby can be found in commonly assigned U.S. Pat. Nos. 4,514,345, issued Apr. 30, 1985 to Johnson et al.; 4,528,239, issued Jul. 9, 1985 to Trokhan; 4,529,480, issued Jul. 16, 1985 to Trokhan; and 4,637,859, issued Jan. 20, 1987 to Trokhan. The foregoing four patents are incorporated herein by reference for the purpose of showing preferred constructions of patterned resinous framework and reinforcing type through-air-drying belts, and the products made thereon. Such belts have been used to produce extremely commercially successful products such as Bounty paper towels and Charmin Ultra toilet tissue, both produced and sold by the instant assignee.

As noted above, such through-air-drying belts used a reinforcing element to stabilize the resin. The reinforcing element also controlled the deflection of the papermaking fibers resulting from vacuum applied to the backside of the belt and airflow through the belt. The early belts of this type used a fine mesh reinforcing element, typically having approximately fifty machine direction and fifty cross-machine direction yarns per inch. While such a fine mesh was acceptable from the standpoint of controlling fiber deflection into the belt, it was unable to stand the environment of a typical papermaking machine. For example, such a belt was so flexible that destructive folds and creases often occurred. The fine yarns did not provide adequate seam strength and would often burn at the high temperatures encountered in papermaking.

Yet other drawbacks were noted in the early embodiments of this type of through-air-drying belt. For example, the continuous pattern used to produce the consumer preferred product did not allow leakage through the backside of the belt. In fact, such leakage was minimized by the necessity to securely lock the resinous pattern onto the reinforcing structure. Unfortunately, when the lock-on of the resin to the reinforcing structure was maximized, the short rise time over which the differential pressure was applied to an individual region of fibers during the application of vacuum often pulled the fibers through the reinforcing element, resulting in process hygiene problems and product acceptance problems, such as pinholes.

A new generation of patterned resinous framework and reinforcing structure through-air-drying belts addressed some of these issues. This generation utilized a dual layer reinforcing structure having vertically stacked machine direction yarns. A single cross-machine direction yarn system tied the two machine direction yarns together.

For paper toweling, a coarser mesh, such as thirty-five machine direction yarns and thirty cross-machine direction yarns per inch, dual layer design significantly improved the seam strength and creasing problems. The dual layer design also allowed some backside leakage to occur. Such allowance was caused by using less precure energy in joining the resin to the reinforcing structure, resulting in a compromise between the desired backside leakage and the ability to lock the resin onto the reinforcing structure.

Later designs used an opaque backside filament in the stacked machine direction yarn dual layer design, allowing for higher precure energy and better lock-on of the resin to the reinforcing structure, while maintaining adequate backside leakage. This design effectively decoupled the tradeoff between adequate resin lock-on and adequate backside leakage in the prior art. Examples of such improvements in this type of belt are illustrated by commonly assigned U.S. patent application Ser. No. 07/872,470 filed Jun. 15, 1992, now U.S. Pat. No. 5,334,289 in the names of Trokhan et al., Issue Batch No. V73. Yet other ways to obtain a backside texture are illustrated by commonly assigned U.S. Pat. Nos. 5,098,522, issued Mar. 24, 1992 to Smurkoski et al.; 5,260,171, issued Nov. 9, 1993 to Smurkoski et al.; and 5,275,700, issued Jan. 4, 1994 to Trokhan, which patents and application are incorporated herein by reference for the purpose of showing how to obtain a backside texture on a patterned resin and reinforcing structure through-air-drying belt.

As such resinous framework and reinforcing structure belts were used to make tissue, such as the commercially successful Charmin Ultra noted above, new issues arose. For example, one problem in tissue making is the formation of small pinholes in the deflected areas of the web. Pinholes are strongly related to the depth that the web deflects into the belt. The depth comprises both the thickness of the resin on the reinforcing structure, and any pockets within the reinforcing structure that permits the fibers to deflect beyond the imaginary top surface plane of the reinforcing structure. Typical stacked machine direction yarn dual layer reinforcing structure designs have a variety of depths resulting from the particular weave configuration. The deeper the depth within a particular location of the weave that is registered with a deflection conduit in the resin, the greater the proclivity for a pinhole to occur in that area.

Recent work according to the present invention has shown that the use of triple layer reinforcing structures unexpectedly reduces occurrences of pinholes. Triple layer reinforcing structures comprise two completely independent woven elements, each having its own particular machine direction and cross-machine direction mesh. The two independent woven elements are typically linked together with tie yarns.

More particularly, the triple layer belt preferably uses a finer mesh square weave as the upper layer, to contact the web and minimize pinholes. The lower layer or machine facing layer utilizes coarser yarns to increase rigidity and improve seam strength. The tie yarns may be machine direction or cross-machine direction yarns specifically added and which were not present in either layer.

Alternatively, the tie yarns may be comprised of cross-machine direction or machine direction tie yarns from the upper and/or lower element of the reinforcing structure. Machine direction yarns are preferred for the tie yarns because of the increased seam strength they provide.

However, this design still does not solve the problem where backside leakage may be required. Reference to the prior art teachings of backside texturing do not solve this problem either. For example, the aforementioned U.S. patent application Ser. No. 07/872,470, now U.S. Pat. No. 5,334,289, teaches the use of opaque yarns to prevent curing of resin therebelow. The resin that is not cured is washed away during the belt making process and imparts a texture to the backside of the belt. However, such a teaching further states that it is preferable the machine direction yarns be opaque because the machine direction yarns are generally disposed closer to the backside surface of the reinforcing structure than the cross-machine yarns. Such a description is not correct, however, if the machine direction yarns are used as tie yarns.

Thus, the machine direction yarn must serve either one of two mutually exclusive functions: it must either remain within the lower layer to prevent texture from going too deep into the belt, or rise out of the lower layer to tie the lower layer relative to the first layer. Compounding the problem with triple layer belts is any opaque machine direction yarns used as tie yarns will disrupt the lock-on of the resin below because such yarns intermittently are disposed on the top-side of the reinforcing structure.

Accordingly, it is an object of this invention to provide a belt which overcomes the tradeoff between high seam strength and minimal pinholing. It is further an object of this invention to provide a belt which overcomes the tradeoffs between backside leakage and low resin lock-on. The prior art has not yet provided a belt which produces consumer desired products (minimal pinholing) with a long lasting belt (high seam strength and high rigidity) and which does not lose functional components during the manufacture of the consumer product (poor resin lock-on).

SUMMARY OF THE INVENTION

The invention comprises a cellulosic fibrous structure through-air-drying belt. The belt comprises a reinforcing structure comprising a web facing first layer of interwoven machine direction yarns and cross-machine direction yarns. The machine direction and cross-machine direction yarns of the first layer have a first opacity which is substantially transparent to actinic radiation and are interwoven in a weave. The reinforcing structure also comprises a machine facing second layer of interwoven machine direction and cross-machine direction yarns. A plurality of the machine direction or cross-machine direction yarns of the second layer have a second opacity. The second opacity is greater than the first opacity and is substantially opaque to actinic radiation. The machine direction and cross-machine direction yarns of the second layer are interwoven in a weave. The first layer and second layer are tied together by a plurality of tie yarns. The tie yarns have an opacity less than the second opacity and are substantially transparent to actinic radiation.

The belt further comprises a pattern layer extending outwardly from the first layer and into the second layer, wherein the pattern layer provides a web contacting surface facing outwardly from the web facing surface of the first layer. The pattern layer stabilizes the first layer relative to the second layer during the manufacture of the cellulosic fibrous structures. The pattern layer has a backside texture on the machine facing surface of the second layer which is registered with the yarns of the second layer having the second opacity. Air flow through the cellulosic fibrous structure and the backside texture removes water from the cellulosic fibrous structure.

The tie yarns may be adjunct cross-machine direction or adjunct machine direction tie yarns interwoven with respective machine direction yarns or cross-machine direction yarns of the first and second layers.

The tie yarns may be integral tie yarns which tie the first layer and second layer relative to one another and which are woven within the respective planes of the first and second layers and additionally are interwoven with the respective yarns of the other layer.

DETAILED DESCRIPTION OF THE INVENTION

Figure 1:
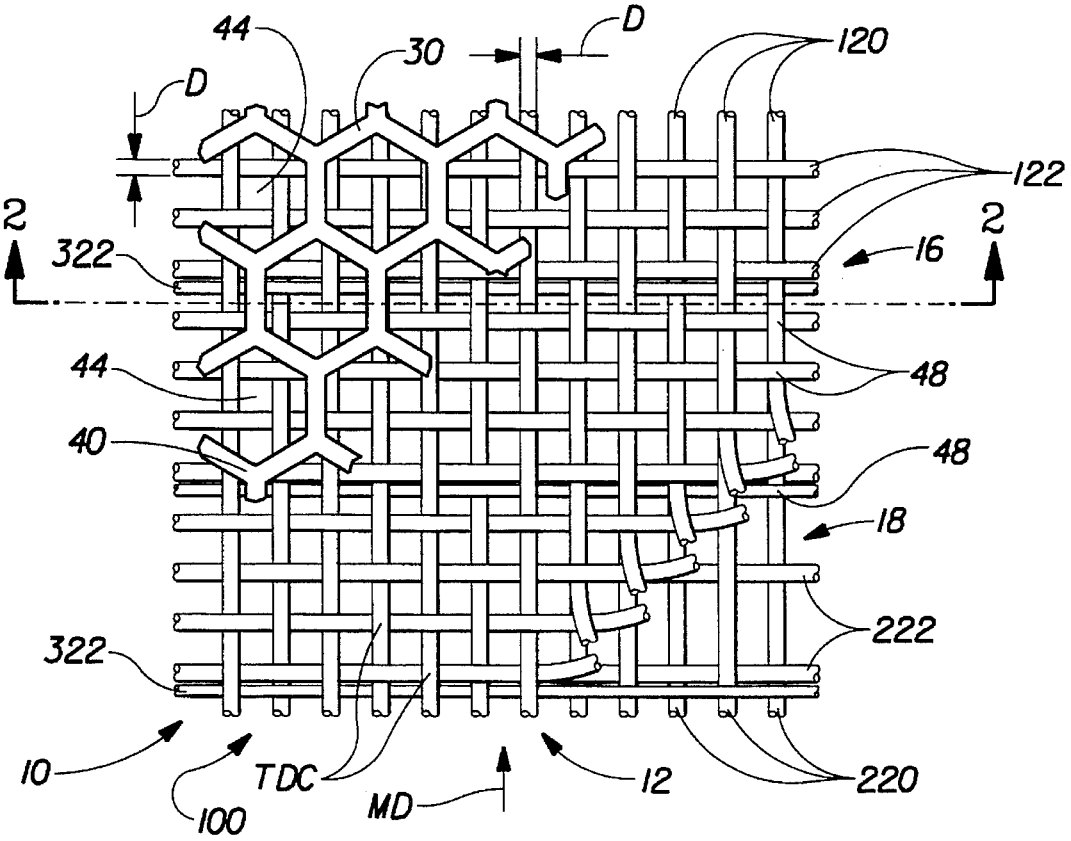
FIG. 1 is a fragmentary top plan view of a belt according to the present invention, having adjunct tie yarns and shown partially in cutaway for clarity.
Figure 2:
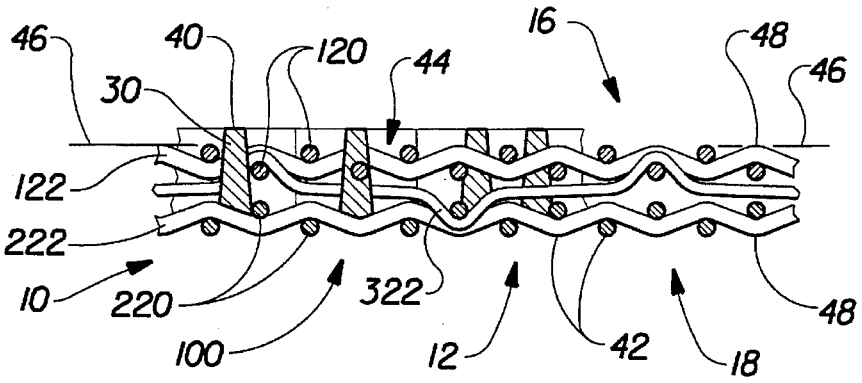
FIG. 2 is a vertical sectional view taken along line 2—2 of FIG. 1.

Referring to FIGS. 1 and 2, the belt 10 of the present invention is preferably an endless belt and carries a web of cellulosic fibers from a forming wire to a drying apparatus, typically a heated drum, such as a Yankee drying drum (not shown). The belt 10 of the present invention comprises two primary elements: a reinforcing structure 12 and a pattern layer 30. The reinforcing structure 12 is further comprised of at least two layers, a web facing first layer 16 and a machine facing second layer 18. Each layer 16, 18 of the reinforcing structure 12 is further comprised of interwoven machine direction yarns 120, 220 and cross-machine direction yarns 122, 222. The reinforcing structure 12 further comprises tie yarns 322 interwoven with the respective yarns 100 of the web facing layer 16 and the machine facing layer 18.

As used herein, yarns 100 is generic to and inclusive of machine direction yarns 120, cross-machine direction yarns 122 of the first layer 16, as well as machine direction yarns 220 and cross-machine direction yarns 222 of the second layer 18.

The second primary element of the belt 10 is the pattern layer 30. The pattern layer 30 is cast from a resin onto the top of the first layer 16 of the reinforcing structure 12. The pattern layer 30 penetrates the reinforcing structure 12 and is cured into any desired binary pattern by irradiating liquid resin with actinic radiation through a binary mask having opaque sections and transparent sections.

Referring to FIG. 2, the belt 10 has two opposed surfaces, a web contacting surface 40 disposed on the outwardly facing surface of the pattern layer 30 and an opposed backside 42. The backside 42 of the belt 10 contacts the machinery used during the papermaking operation. Such machinery (not illustrated) includes a vacuum pickup shoe, vacuum box, various rollers, etc.

The belt 10 may further comprise conduits 44 extending from and in fluid communication with the web contacting surface 40 of the belt 10 to the backside 42 of the belt 10. The conduits 44 allow deflection of the cellulosic fibers normal to the plane of the belt 10 during the papermaking operation.

Figure 4A:
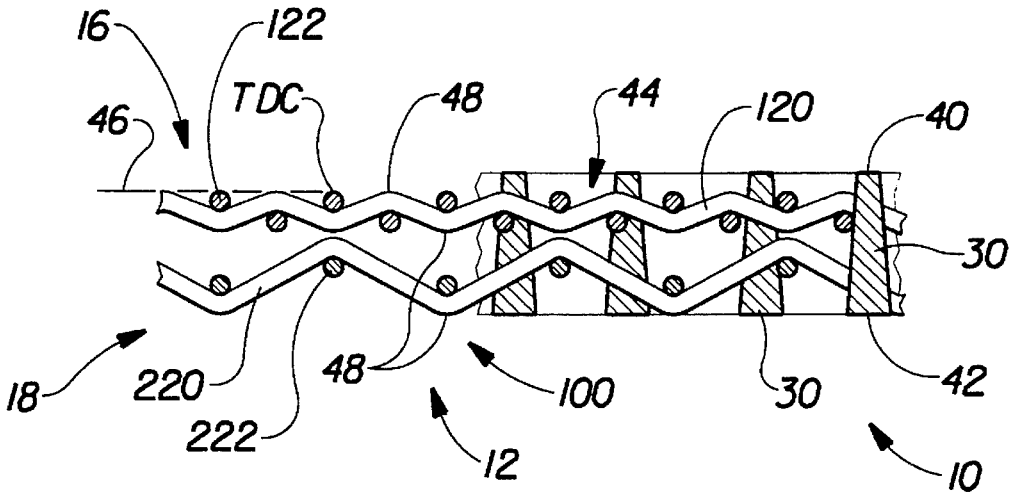
FIGS. 4A and 4B are vertical sectional views taken along line 4A—4A and 4B—4B of FIG. 3 and having the pattern layers partially removed for clarity.
Figure 4B:
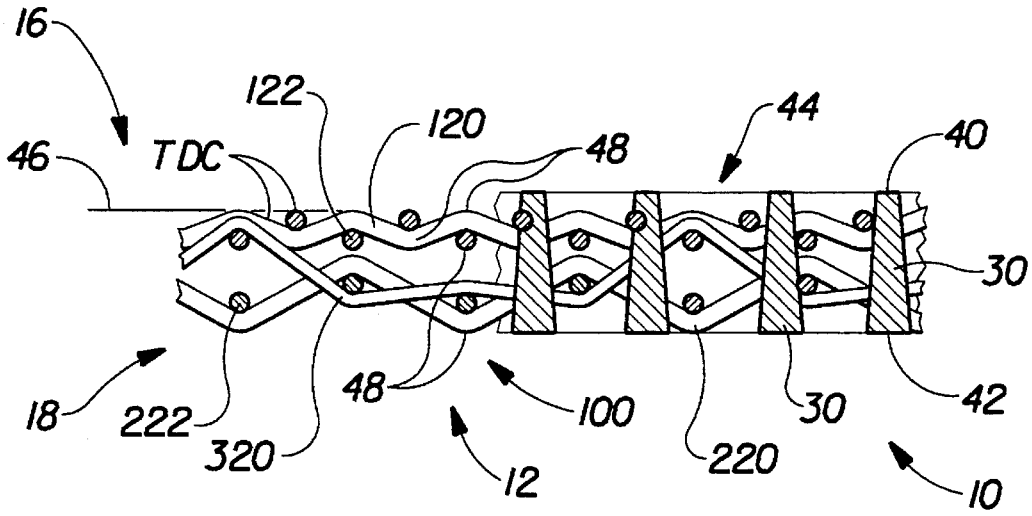

The conduits 44 may be discrete, as shown, if an essentially continuous pattern layer 30 is selected. Alternatively, the pattern layer 30 can be discrete and the conduits 44 may be essentially continuous. Such an arrangement is easily envisioned by one skilled in the art as generally opposite that illustrated in FIG. 1. Such an arrangement, having a discrete pattern layer 30 and an essentially continuous conduit 44, is illustrated in FIG. 4 of the aforementioned U.S. Pat. No. 4,514,345 issued to Johnson et al. and incorporated herein by reference. Of course, it will be recognized by one skilled in the art that any combination of discrete and continuous patterns may be selected as well.

The pattern layer 30 is cast from photosensitive resin, as described above and in the aforementioned patents incorporated herein by reference. The preferred method for applying the photosensitive resin forming the pattern layer 30 to the reinforcing structure 12 in the desired pattern is to coat the reinforcing layer with the photosensitive resin in a liquid form. Actinic radiation, having an activating wavelength matched to the cure of the resin, illuminates the liquid photosensitive resin through a mask having transparent and opaque regions. The actinic radiation passes through the transparent regions and cures the resin therebelow into the desired pattern. The liquid resin shielded by the opaque regions of the mask is not cured and is washed away, leaving the conduits 44 in the pattern layer 30.

It has been found, as identified in the aforementioned commonly assigned U.S. patent application Ser. No. 07/872,470, now U.S. Pat. No. 5,334,289 filed in the name of Trokhan et al. and incorporated herein by reference, that opaque machine direction yarns 220 or cross-machine direction yarns 222 may be utilized to mask the portion of the reinforcing structure 12 between such machine direction yarns 220 and cross-machine direction yarns 222 and the backside 42 of the belt 10 to create a backside texture. The aforementioned application is incorporated herein by reference for the purpose of illustrating how to incorporate such opaque yarns 220, 222 into a reinforcing structure 12 according to the present invention. The yarns 220, 222 of the second layer 18 may be made opaque by coating the outsides of such yarns 220, 222, adding fillers such as carbon black or titanium dioxide, etc.

The actinic radiation does not pass through the yarns 220, 222 of the second layer 18 which are substantially opaque. This results in a backside texture on the machine facing surface of the second layer 18. The backside texture is registered with the yarns 220, 222 of the second layer 18 having the second opacity and which are substantially opaque to actinic radiation. Air flow through the cellulosic fibrous structure and through the backside texture removes water from the cellulosic fibrous structure.

However, this attempt in the prior art teaches using the machine direction yarns 220 for this purpose. However, as noted below, such a teaching is not always desirable, with a reinforcing structure 12 according to the present invention and which seeks to overcome the belt life disadvantages discussed above.

The pattern layer 30 extends from the backside 42 of the second layer 18 of the reinforcing structure 12, outwardly from and beyond the first layer 16 of the reinforcing structure 12. Of course, as discussed more fully below, not all of the pattern layer 30 extends to the outermost plane of the backside 42 of the belt 10. Instead, some portions of the pattern layer 30 do not extend below particular yarns 220, 222 of the second layer 18 of the reinforcing structure 12. The pattern layer 30 also extends beyond and outwardly from the web facing surface of the first layer 16 a distance of about 0.002 inches (0.05 millimeter) to about 0.050 inches (1.3 millimeters). The dimension of the pattern layer 30 perpendicular to and beyond the first layer 16 generally increases as the pattern becomes coarser. The distance the pattern layer 30 extends from the web facing surface of the first layer 16 is measured from the plane 46 in the first layer 16, furthest from the backside 42 of the second layer 18. As used herein, a "knuckle" is the intersection of a machine direction yarn 120, 220 and a cross-machine direction yam 122, 222.

The term "machine direction" refers to that direction which is parallel to the principal flow of the paper web through the papermaking apparatus. The "cross-machine direction" is perpendicular to the machine direction and lies within the plane of the belt 10.

As noted above, different yarns 100 of the belt 10 have a different opacity. The opacity of a yarn 100 is the ratio of the amount of actinic radiation which does not pass through the yarn 100 (due to either reflectance, scattering or absorption) to the amount actinic radiation incident upon the yarn 100. As used herein, the "specific opacity" of a yarn 100 refers to the opacity per unit diameter of a round yarn 100.

It is to be recognized that the local opacity may vary throughout a given cross section of the yarn 100. However, the opacity refers to the aggregate opacity of a particular cross section, as described above, and not to the opacity represented by any of the different elements comprising the diameter.

The machine direction and cross-machine direction yarns 120, 122 are interwoven into a web facing first layer 16. Such a first layer 16 may have a one-over, one-under square weave, or any other weave which has a minimal deviation from the top plane 46. Preferably the machine direction and cross-machine direction yarns 120, 122 comprising the first layer 16 have a first opacity. The first opacity should be low enough so that the machine direction and cross-machine direction yarns 120, 122 comprising the first layer 16 are substantially transparent to actinic radiation which is used to cure the pattern layer 30. Such yarns 120, 122 are considered to be substantially transparent if actinic radiation can pass through the greatest cross-sectional dimension of the yarns 120, 122 in a direction generally perpendicular to the plane of the belt 10 and still sufficiently cure photosensitive resin therebelow.

The machine direction yarns 220 and cross-machine direction yarns 222 are also interwoven into a machine facing second layer 18. The yarns 220, 222, particularly the cross-machine direction yarns 222, of the machine facing second layer 18 are preferably larger than the yarns 120, 122 of the first layer 16, to improve seam strength.

This result may be accomplished by providing cross-machine direction yarns 222 of the second layer 18 which are larger in diameter than the machine direction yarns 120 of the first layer—if yarns 100 having a round cross section are utilized. If yarns 100 having a different cross section are utilized, this may be accomplished by providing machine direction yarns 220 in the second layer of a greater cross section than the machine direction yarns 120 of the first layer. Alternatively, and less preferably, the machine direction yarns 220 of the second layer 18 may be made of a material having a greater tensile strength than the yarns 120, 122 of the first layer 16.

Preferably, the second layer 18 has a square weave, in order to maximize seam strength.

In any embodiment, the machine direction and/or cross-machine direction yarns 220, 222 of the second layer 18 have a second opacity and/or second specific opacity, which are greater than the first opacity and/or first specific opacity, respectively, of the yarns 120, 122 of the first layer 16. The yarns 220, 222 of the second layer are substantially opaque to actinic radiation. By "substantially opaque" it is meant that liquid resin in the shadow of yarns 220, 222 having such opacity does not cure to a functional pattern layer 30, but instead is washed away as part of the belt 10 manufacturing process.

The machine direction and cross-machine direction yarns 220, 222 comprising the second layer 18 may be woven in any suitable pattern, such as a square weave, as shown, or a twill or broken twill weave and/or any suitable shed. If desired, the second layer 18 may have a cross-machine direction yarn 222 in every other position, corresponding to the cross-machine direction yarns 122 of the first layer. It is more important that the first layer 16 have multiple and more closely spaced cross-machine direction yarns 122, to provide sufficient fiber support. Generally, the machine direction yarns 220 of the second layer 18 occur with a frequency coincident that of the machine direction yarns 120 of the first layer 16, in order to preserve seam strength.

Adjunct tie yarns 320, 322 may be interposed between the first layer 16 and the second layer. 18. The adjunct tie yarns 320, 322 may be machine direction tie yarns 320 which are interwoven with respective cross-machine direction yarns 122, 222 of the first and second layers 16, 18, or cross-machine direction tie yarns 322, which are interwoven with the respective machine direction yarns 120, 220 of the first and second layers 16, 18. As used herein, tie yarns 320, 322 are considered to be "adjunct" if such tie yarns 320, 322 do not comprise a yarn 100 inherent in the weave selected for either of the first or second layers 16, 18, but instead is in addition to and may even disrupt the ordinary weave of such layers 16, 18.

Preferably the adjunct tie yarns 320, 322 are smaller in diameter than the yarns 100 of the first and second layers 16, 18, so such tie yarns 320, 322 do not unduly reduce the projected open area of the belt 10.

A preferred weave pattern for the adjunct tie yarns 320, 322 has the least number of tie points necessary to stabilize the first layer 16 relative to the second layer 18. The tie yarns 324 are preferably oriented in the cross-machine direction because this arrangement is generally easier to weave.

Contrary to the types of weave patterns dictated by the prior art, the stabilizing effect of the pattern layer 30 minimizes the number of tie yarns 320, 322 necessary to engage the first layer 16 and the second layer 18. This is because the pattern layer 30 stabilizes the first layer 16 relative to the second layer 18 once casting is complete and during the paper manufacturing process. Accordingly, smaller and fewer adjunct tie yarns 320, 322 may be selected, than the yarns 100 used to make the first or second layers 16, 18.

Yet another problem caused by the tie yarns 320, 322 is the difference in effective fiber support. The tie yarns 320, 322 intersticially obturate certain openings between the machine direction and cross-machine yarns 120, 122 of the first layer 16, causing differences in finished product uniformity.

Adjunct tie yarns 320, 322 comprising relatively fewer and smaller yarns are desirable, because the adjunct tie yarns 320, 322, of course, block the projected open area through the belt 10. It is desirable that the entire reinforcing structure 12 have a projected open area of at least 25 percent. The open area is necessary to provide a sufficient path for the air flow therethrough to occur. If limiting orifice drying, such as is beneficially described in commonly assigned U.S. Pat. No. 5,274,930 issued Jan. 4, 1994 to Ensign et al. is desired, it becomes even more important that the belt 10 has sufficient open area.

The projected open area of the reinforcing structure 12 may be determined (providing it is not too transparent) in accordance with the method for determining projected average pore size set forth in commonly assigned U.S. Pat. No. 5,277,761 issued Jan. 11, 1994 to Phan and Trokhan, which patent is incorporated herein by reference for the purpose of showing a method to determine the projected open area of the reinforcing structure. Of course, it is important that the pattern layer 30 not be included in the projected open area calculation. This may be accomplished by thresholding out the color of the pattern layer 30 or by immersing the belt 10 in a liquid which has a refractive index that matches that of the pattern layer 30 and then performing the projected open area analysis.

More importantly, the reinforcing structure 12 according to the present invention must allow sufficient air flow perpendicular to the plane of the reinforcing structure 12. The reinforcing structure 12 preferably has an air permeability of at least 900 standard cubic feet per minute per square foot, preferably at least 1,000 standard cubic feet per minute per square foot, and more preferably at least 1,100 standard cubic feet per minute per square foot. Of course the pattern layer 30 will reduce the air permeability of the belt 10 according to the particular pattern selected. The air permeability of a reinforcing structure 12 is measured under a tension of 15 pounds per linear inch using a Valmet Permeability Measuring Device from the Valmet Company of Finland at a differential pressure of 100 Pascals. If any portion of the reinforcing structure 12 meets the aforementioned air permeability limitations, the entire reinforcing structure 12 is considered to meet these limitations.

The tie yarns 320, 322 have an opacity and/or specific opacity which is less than the second opacity and/or second specific opacity, respectively, of the machine direction yarns 220 of the second layer 18. The adjunct tie yarns 320, 322 are substantially transparent to actinic radiation.

Figure 3:
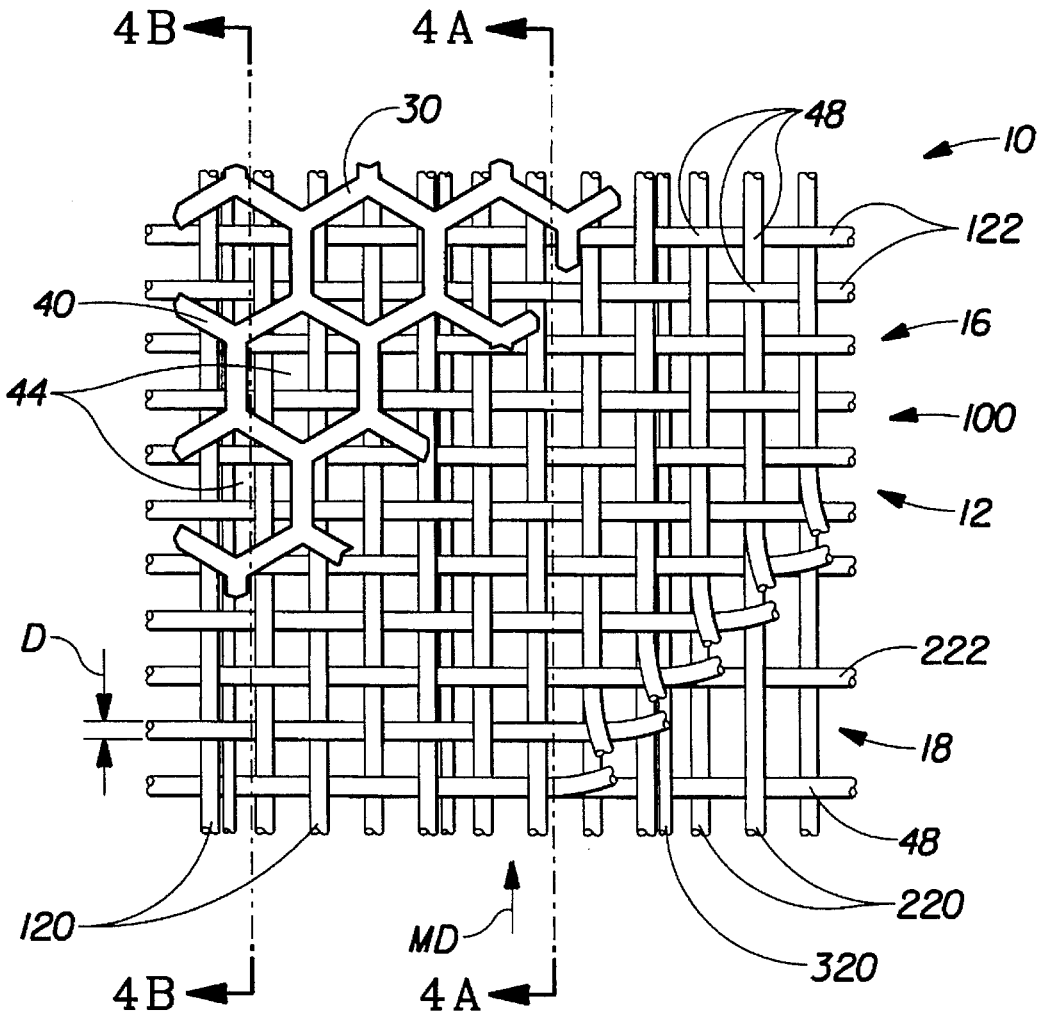
FIG. 3 is a fragmentary top plan view of a belt having the first and second layers tied together by integral tie yarns from the second layer, and shown partially in cutaway for clarity.

Referring to FIGS. 3 and 4, if desired, the adjunct tie yarns 320, 322 may be omitted. Instead of adjunct tie yarns 320, 322, a plurality of machine direction or cross-machine direction yarns 320, 322 of the second layer 18 may be interwoven with respective cross-machine direction or machine direction yarns 122, 120 of the first layer 16. These interwoven yarns 320, 322 which do not remain in the plane of the second layer 18 are hereinafter referred to as integral "tie yarns" 320, 322 because these integral tie yarns 320, 322 which join the first and second layers 16, 18, and stabilize the second layer 18 relative to the first layer 16 are inherently found in the weave of at least one such layer 16, 18. The yarns 100 which remain within the plane of the first or second layer 16, 18 are referred to as non-tie yarns 100.

Preferably the integral tie yarns 320, 322 of the second layer 18 which are interwoven with the respective cross-machine direction or machine direction yarns 122, 120 of the first layer 16 are machine direction tie yarns 320, to maximize seam strength. However, arrangements having cross-machine direction integral tie yarns 322 may be utilized.

Preferably the integral tie yarns 320, 322 of the second layer 18 have an opacity and a specific opacity which is less than the second opacity and the second specific opacity of the yarns 220, 222 of the second layer 18, so that the integral tie yarns 320, 322 are substantially transparent to actinic radiation. A plurality of the non-tie yarns 220, 222 of the second layer 18 have a second opacity and/or specific opacity which is greater than the first opacity and/or specific opacity, respectively, and which is substantially opaque to actinic radiation.

In an alternative embodiment (not shown), the integral tie yarns 322, 320 may extend from the first layer 16 and be interwoven with the respective machine direction or cross-machine direction yarns 220, 222 of the second layer 18. This embodiment may be easily envisioned by turning FIGS. 4A and 4B upside down.

Alternatively, the integral tie yarns 320, 322 may emanate from both the first and second layers 16, 18, in a combination of the two foregoing teachings. Of course, one skilled in the art will recognize this arrangement may be used in conjunction with adjunct tie yarns 320, 322 as well.

While other embodiments of the invention are feasible, given the various combinations and permutations of the foregoing teachings, it is not intended to thereby limit the present invention to only that which is shown and described above.

What is claimed is:

1. A cellulosic fibrous structure through-air-drying belt comprising:

a reinforcing structure comprising:

a web facing first layer of interwoven machine direction yarns and cross-machine direction yarns, said machine direction and cross-machine direction yarns of said first layer having a first opacity substantially transparent to actinic radiation and being interwoven in a weave;

a machine facing second layer of interwoven machine direction yarns and cross-machine direction yarns, a plurality of said machine direction or said cross-machine direction yarns of said machine facing second layer having a second opacity greater than said first opacity and being substantially opaque to actinic radiation, said machine direction yarns and said cross-machine direction yarns of said second layer being interwoven in a weave, said first layer and said second layer being tied together by a plurality of tie yarns, said tie yarns having an opacity less than said second opacity and being substantially transparent to actinic radiation; and a pattern layer extending outwardly from said first layer and into said second layer, wherein said pattern layer provides a web contacting surface facing outwardly from said web facing surface of said first layer, said pattern layer connecting said first layer and said second layer, whereby said pattern layer stabilizes said first layer relative to said second layer during the manufacture of cellulosic fibrous structures thereon, said pattern layer having a backside texture on said machine facing surface of said second layer and registered with said yarns of said second layer having said second opacity, whereby airflow through said cellulosic fibrous structure and through said backside texture removes water from said cellulosic fibrous structure.

2. A cellulosic fibrous structure through-air-drying belt comprising:

a reinforcing structure comprising:

a web facing first layer of interwoven machine direction yarns and cross-machine direction yarns, a plurality of said machine direction and cross-machine direction yarns of said first layer having a first opacity substantially transparent to actinic radiation and being interwoven in a weave;

a machine facing second layer of interwoven machine direction yarns and cross-machine direction yarns, a plurality of said machine direction or said cross-machine direction yarns of said machine facing second layer having a second opacity greater than said first opacity and being substantially opaque to actinic radiation, said machine direction yarns and said cross-machine direction yarns of said second layer being interwoven in a weave;

adjunct cross-machine or adjunct machine direction tie yarns interwoven with respective machine direction yarns or cross-machine direction yarns of said web contacting layer and said machine facing layer to tie said first layer and second layer relative to one another, said adjunct tie yarns having an opacity less than said second opacity of said yarns of said second layer and being substantially transparent to actinic radiation; and a pattern layer extending outwardly from said first layer and into said second layer, wherein said pattern layer provides a web contacting surface facing outwardly from said web facing surface of said first layer, said pattern layer connecting said first layer and said second layer, whereby said pattern layer stabilizes said first layer relative to said second layer during the manufacture of cellulosic fibrous structures thereon, said pattern layer having a backside texture on said machine facing surface of said second layer and registered with said yarns of said second layer having said second opacity, whereby airflow through said cellulosic fibrous structure and through said backside texture removes water from said cellulosic fibrous structure.

3. A cellulosic fibrous structure through-air-drying belt comprising:

a reinforcing structure comprising:

a web facing first layer of interwoven machine direction yarns and cross-machine direction yarns, said machine direction and cross-machine direction yarns having a first opacity substantially transparent to actinic radiation and being interwoven in a weave;

a machine facing second layer of interwoven machine direction yarns and cross-machine direction yarns, said machine direction and cross-machine direction yarns of said machine facing second layer being interwoven in a weave, wherein a plurality of said machine direction yarns or cross-machine direction yarns of said first layer or said second layer are interwoven with respective cross-machine direction yarns or machine direction yarns of said other layer as integral tie yarns to tie said first layer and said second layer relative to one another, the balance of said yarns of said first layer and said second layer being non-tie yarns and remaining in the respective planes of said first layer and said second layer;

a plurality of said non-tie yarns of said second layer having a second opacity greater than said first opacity, wherein said second opacity is substantially opaque to actinic radiation; and a pattern layer extending outwardly from said first layer and into said second layer, wherein said pattern layer provides a web contacting surface faced outwardly from said web facing surface of said first layer, said pattern layer connecting said first layer and said second layer, whereby said pattern layer stabilizes said first layer relative to said second layer during the manufacture of cellulosic fibrous structures thereon, said pattern layer having a backside texture on said machine facing surface of said second layer and registered with said yarns of said second layer having said second opacity, whereby airflow through said cellulosic fibrous structure and through said backside texture removes water from said cellulosic fibrous structure.

4. A belt according to claim 2 wherein said machine direction or cross-machine direction tie yarns are smaller in diameter than the diameter of said cross-machine direction yarns of said second layer.

5. A belt according to claim 4 wherein said machine direction or cross-machine direction tie yarns are smaller in diameter than the diameter of said cross-machine direction yarns of said first layer.

6. A belt according to claim 3 wherein a plurality of said integral tie yarns of said first layer are equal in diameter to said machine direction non-tie yarns of said first layer.

7. A belt according to claim 6 wherein a plurality of said integral tie yarns of said second layer are equal in diameter to said machine direction non-tie yarns of said second layer.

8. A belt according to claim 2 wherein said yarns of said second layer and said adjunct tie yarns are round, and said yarns of said second layer have a greater specific opacity than said tie yarns.

9. A belt according to claim 8 wherein said yarns of said second layer having said second specific opacity contain an opacifying agent.

10. A belt according to claim 8 wherein said adjunct tie yarns are smaller in diameter than said non-tie yarns of said second layer.

11. A belt according to claim 3 wherein said non-tie yarns of said second layer and said integral tie yarns are round, and said non-tie yarns of said second layer have a greater specific opacity than said integral tie yarns.

12. A belt according to claim 11 wherein said yarns of said second layer having said second specific opacity contain an opacifying agent.

13. A belt according to claim 11 wherein said non-tie yarns of said second layer and said tie yarns are of the same diameter.

14. A belt according to claim 4 wherein said web contacting surface of said pattern layer comprises an essentially continuous network having a plurality of discrete openings therein, said discrete openings being in fluid communication with said first layer.

15. A belt according to claim 14 wherein said reinforcing structure has an air permeability of at least 900 standard cubic feet per minute per square foot.

16. A belt according to claim 15 wherein said reinforcing structure has an air permeability of at least 1,100 standard cubic feet per minute per square foot.

17. A belt according to claim 6 wherein said web contacting surface of said pattern layer comprises an essentially continuous network having a plurality of discrete openings therein, said discrete openings being in fluid communication with said first layer.

18. A belt according to claim 17 wherein said reinforcing structure has an air permeability of at least 900 standard cubic feet per minute per square foot.

19. A belt according to claim 18 wherein said reinforcing structure has an air permeability of at least 1,100 standard cubic feet per minute per square foot.

20. A belt according to claim 3 wherein said tie yarns comprise machine direction yarns of said second layer.

21. A belt according to claim 20 wherein said tie yarns comprise machine direction yarns of said first layer and said second layer.

22. A belt according to claim 3 wherein said non-tie yarns of said second layer comprise a square weave.

23. A belt according to claim 1 wherein a plurality of said machine direction yarns and said cross-machine direction yarns of said machine facing second layer has a second opacity greater than said first opacity and is substantially opaque to actinic radiation.

24. A belt according to claim 2 wherein a plurality of said machine direction yarns and said cross-machine direction yarns of said machine facing second layer has a second opacity greater than said first opacity and is substantially opaque to actinic radiation.

25. A belt according to claim 3 wherein a plurality of said machine direction yarns and said cross-machine direction yarns of said machine facing second layer has a second opacity greater than said first opacity and is substantially opaque to actinic radiation.

* * * * *